US009381737B2

(12) United States Patent
Stephens et al.

(10) Patent No.: US 9,381,737 B2
(45) Date of Patent: Jul. 5, 2016

(54) METHOD OF MANUFACTURING A PRINT HEAD

(71) Applicant: XEROX CORPORATION, Norwalk, CT (US)

(72) Inventors: Terrance L. Stephens, Canby, OR (US); Dan Leo Massopust, Eau Claire, WI (US); John R. Andrews, Fairport, NY (US); Christopher J. Laharty, Oregon City, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/098,122

(22) Filed: Dec. 5, 2013

(65) Prior Publication Data

US 2014/0090248 A1 Apr. 3, 2014

Related U.S. Application Data

(62) Division of application No. 12/795,605, filed on Jun. 7, 2010, now Pat. No. 8,628,173.

(51) Int. Cl.

| | |
|---|---|
| ***B21D 53/76*** | (2006.01) |
| ***B23P 17/00*** | (2006.01) |
| ***B41J 2/01*** | (2006.01) |
| ***B41J 2/14*** | (2006.01) |
| ***B41J 2/16*** | (2006.01) |

(52) U.S. Cl.

CPC ..... *B41J 2/01* (2013.01); *B41J 2/14072* (2013.01); *B41J 2/14201* (2013.01); *B41J 2/1601* (2013.01); *B41J 2/1607* (2013.01); *B41J 2/1623* (2013.01); *B41J 2/1631* (2013.01); *B41J 2/1632* (2013.01); *B41J 2/1634* (2013.01); *B41J 2002/14491* (2013.01); *Y10T 29/49401* (2015.01)

(58) Field of Classification Search

CPC ..... B41J 2/1623; B41J 2/1631; B41J 2/1632; Y10T 29/49401; Y10T 29/42; Y10T 29/49117; Y10T 29/49124

USPC ..... 29/890.1, 25.35, 825, 829

See application file for complete search history.

(56) References Cited

U.S. PATENT DOCUMENTS

| | | | | |
|---|---|---|---|---|
| 5,764,267 | A * | 6/1998 | Akutsu et al. | 347/199 |
| 5,889,539 | A * | 3/1999 | Kamoi et al. | 347/50 |
| 5,984,447 | A * | 11/1999 | Ohashi | 347/9 |
| 6,161,270 | A * | 12/2000 | Ghosh et al. | 29/25.35 |
| 6,241,340 | B1 * | 6/2001 | Watanabe et al. | 347/50 |
| 6,270,193 | B1 * | 8/2001 | Hiwada | 347/50 |
| 6,641,254 | B1 * | 11/2003 | Boucher et al. | 347/50 |
| 6,891,314 | B2 * | 5/2005 | Sato et al. | 310/328 |
| 6,905,342 | B2 * | 6/2005 | Swier et al. | 439/65 |
| RE39,474 | E * | 1/2007 | Hashizume et al. | 29/25.35 |
| 7,475,964 | B2 * | 1/2009 | Benson et al. | 347/50 |
| 2006/0042826 | A1 * | 3/2006 | Kondo | 174/255 |
| 2008/0170102 | A1 * | 7/2008 | Kim et al. | 347/50 |
| 2008/0313895 | A1 * | 12/2008 | Higuchi et al. | 29/841 |
| 2013/0061469 | A1 * | 3/2013 | Dolan et al. | 29/830 |

* cited by examiner

*Primary Examiner* — Paul D Kim

(74) *Attorney, Agent, or Firm* — Marger Johnson

(57) ABSTRACT

A method of manufacturing a print head includes forming a jet stack having an array of jets, arranging an array of transducers on the jet stack such that each transducer in the array of transducers corresponds to each jet in the array of jets, embossing a flexible circuit substrate having contact pads such that the contact pads extend out of a plane of the flexible circuit substrate, and arranging the flexible circuit substrate such that the contact pads electrically connect to at least some of the transducers in the array of transducers.

13 Claims, 4 Drawing Sheets

METHOD OF MANUFACTURING A PRINT HEAD

CROSS REFERENCE TO RELATED APPLICATION

This application is a divisional of U.S. patent application Ser. No. 12/795,605, filed on Jun. 7, 2010, now U.S. Pat. No. 8,628,173, entitled "Electrical Interconnect Using Embossed Contacts on a Flex Circuit", which is incorporated herein in its entirety.

BACKGROUND

Current trends within print head design involve increasing the jet packing density and jet count while simultaneously reducing the cost of the print head. The 'jets,' also referred to as nozzles, drop emitters or ejection ports, generally consist of apertures or holes in a plate through which ink is expelled onto a print surface. Higher density and higher counts of jets results in higher resolution and higher quality print images.

Each jet has a corresponding actuator, some sort of transducer that translates an electrical signal to a mechanical force that causes ink to exit the jet. The electrical signals generally result from image data and a print controller that dictates which jets need to expel ink during which intervals to form the desired image. Examples of transducers include piezoelectric transducers, electromechanical transducers, heat generating elements such as those that cause bubbles in the ink for 'bubble jet' printers, etc.

Some of the transducer elements act against a membrane that resides behind the 'jet stack,' a series of plates through which ink is transferred to the nozzle or jet plate. The actuation of the transducers causes the membrane to push against the chambers of the jet stack and ultimately force ink out of the nozzles.

The increased jet packing density and jet count introduce the need for significant reductions in the size and spacing between the actuators, electrical traces, and electromechanical interconnects. The electromechanical interconnect of the most interest here forms the interconnect between the single jet actuators and their corresponding drive electronics through which they receive the signals mentioned above. Current methods make the interconnect between the drive circuitry and the transducers/actuators expensive, and may not have the capability of achieving manufacturable and reliable interconnects at the increased density and reduced sizes desired. Some potential solutions include chip on flex (COF) and tape automated bonding (TAB) technologies where the driving circuitry resides on flexible substrates.

DETAILED DESCRIPTION OF THE EMBODIMENTS

Figure 1:
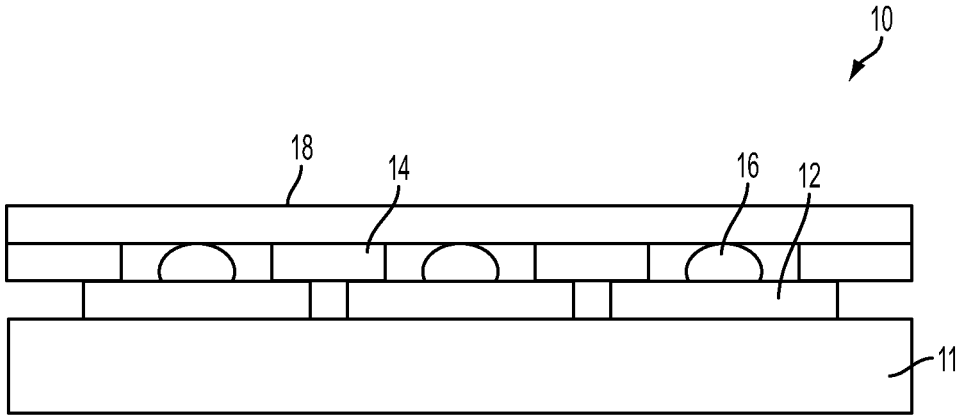
FIG. 1 shows a cross sectional view of a print head having a flex circuit.

FIG. 1 shows a cross-sectional view of a portion of a print head 10. The print head portion shown here shows the jet stack 11, which typically consists of a series of brazed metal plates or combination of metal plates and polymer or adhesive layers. As oriented in the figure, the nozzle or aperture plate would reside at bottom of the jet stack 11. The array of transducers such as 12 reside on the surface of the jet stack opposite the nozzle plate, in this case the top of the jet stack 11. The transducers are electrically connected to the drive circuitry 18 through conductive adhesive 16 typically dispensed into holes in a standoff layer 14. With the increased jet density and tighter spacing, the connection between the drive circuitry and the jet stack 11 becomes more difficult to maintain.

Some approaches have begun to use flexible circuitry substrates such as by mounting the drive chips onto a flexible circuitry using something like tape automated bonding (TAB) or chip on flex (COF). These approaches provide possible solutions to the limited pitch densities and high cost associated with multilayer flex circuits. Another solution or part of a solution is to emboss the flex circuitry substrate such that the contact pads that connect between the flex circuit and the transducers extend out of the plane of the flexible circuit substrate, making a more robust connection.

Figure 2:
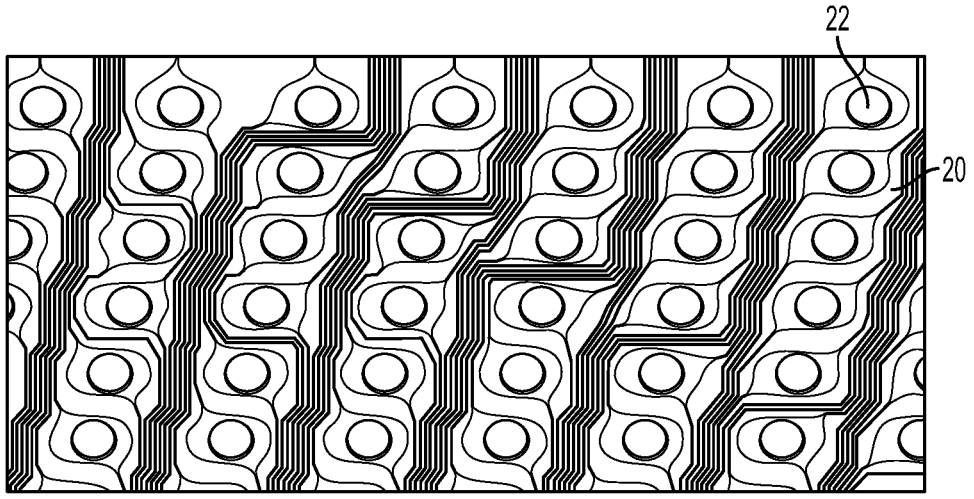
FIG. 2 shows an embodiment of an embossed flex circuit.

FIG. 2 shows an embodiment of a flex circuit substrate 20. The contact pads such as 22 are embossed, meaning that they have had some pressure applied to them to permanently deform them out of the plane of the flex circuit substrate. In this manner, the contact pads can form a more robust interconnect between the flex circuit and the transducer array.

Figure 3:
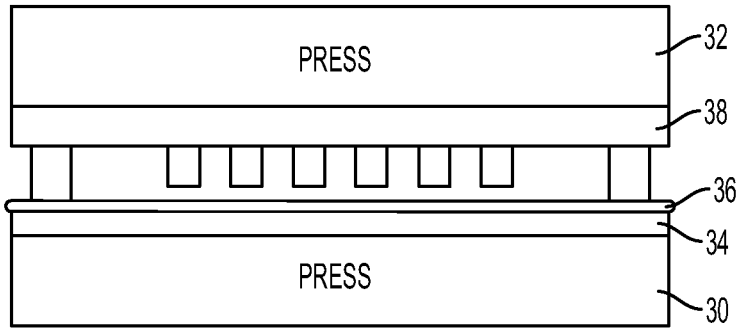
FIGS. 3-5 show embodiments of methods to emboss flex circuits.
Figure 4:
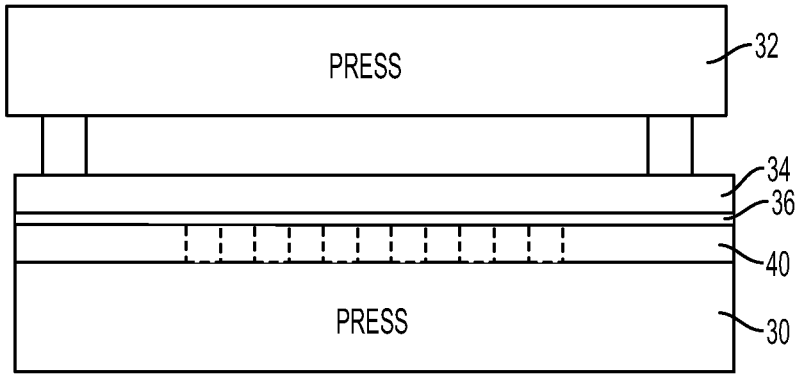
Figure 5:
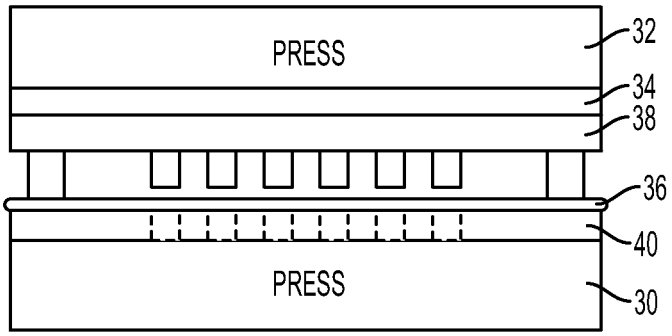

FIGS. 3-5 show embodiments of processes used to emboss the flexible circuit substrate. In these figures, a press is shown having a top and bottom portion with the flex circuit between them. One should note that any type of press may be used, the one shown here is intended merely as an example. In FIG. 3, the press has a bottom portion 30 and an upper portion 32. A compliant pad 34 is placed on the bottom portion. The flex circuit 36 is then arranged on the compliant pad.

An arrayed punch 38 is then arranged over the flex circuit 36. The arrayed punch has an array of individual punches and is aligned such that each individual punch lines up with a contact pad on the flexible circuit substrate. Pressure is then applied to the press, causing the punches to push the contact pads out of the plane of the flexible circuit substrate.

In an alternative method, an arrayed die is used instead of an arrayed punch. In the embodiment of FIG. 4, an arrayed die 40 has an array of openings or holes. The flexible circuit substrate 36 is then arranged over the arrayed die such that the contact pads are aligned over the holes or openings in the arrayed die. A compliant pad is then placed over the flexible circuit and the entire assembly is pressed using the top portion of the press 32. The pressure causes the contact pads to press against the compliant pad in the regions of the holes in the arrayed die, allowing them to extend out of the plane of the flex circuit substrate against the compliant pad.

FIG. 5 shows yet another alternative method of embossing the flexible circuit substrate. FIG. 5 essentially combines the approaches of FIGS. 3 and 4. An arrayed die 40 is placed on the bottom portion of the press. Flexible circuit 36 is then arranged on the arrayed die 40, with the openings of the arrayed die aligned with the contact pads. An arrayed punch is then arranged above the flexible circuit such that the punches are aligned with the contact pads. A compliant pad 34 is then placed over the arrayed punch and the entire assembly is pressed to emboss the flexible circuit.

In any of the above embodiments, the characteristics of the dimple formed on the contact pads can be adjusted by the size, height and shape of the punch and die elements, the stiffness of the compliant pad, as well as the pressure applied by the press. By adjusting these parameters, important aspects of the dimples can be optimized to fit the needs of a particular application.

The punch height was the dominant factor in determining dimple height for the factors studied. One should note that the use of arrayed elements in the above embodiments may be replaced with a single punch, a single die or an arrayed element.

Once the flexible circuit is embossed, several options exist for how to form the interconnect between the flex circuit substrate and the transducer array. For example, one approach uses anisotropic conductive adhesive film (ACF)—also referred to as z-axis tape (ZAT). A second approach uses stenciled or otherwise patterned conductive adhesive with or without a standoff layer. A third approach employs a nonconductive adhesive layer between the flexible circuit substrate and the transducer array with the electrical continuity established by an asperity contact.

Anisotropic conductive film generally consists of conductive particles enclosed in a polymer adhesive layer. The tape is generally nonconductive until application of heat and pressure causes the particles to move within the adhesive to form a conductive path. The below discussion uses two different approaches of forming the interconnect with anisotropic conductive film. In a first approach using anisotropic conductive film, a mask or coverlay layer is used on the flexible circuit substrate. The coverlay is patterned to selectively expose portions of the flexible circuit substrate where interconnection is desired.

Patterning of the coverlay can be accomplished in different ways. For example, an additive method of patterning the coverlay involves patterning the mask when it is created. The pre-patterned mask is then attached to the flex circuit or the flex circuit is manufactured with the patterned mask as part of the manufacturing process. In a subtractive method, a mask covers the entire surface of the flex circuit. Selected areas of the coverlay are then removed, using laser ablation or photolithography. In one embodiment, scanned $CO_2$ lasers or excimer lasers perform the removal process. In the scanned $CO_2$ embodiment, the laser beam may be shuttered and scanned across the flexible circuit substrate and its coverlay to remove the coverlay material from each pad. With an excimer laser process, the laser illuminates the mask and is imaged onto the pads. In higher pad densities, the excimer layer process may result in cleaner and precisely aligned pad openings.

The resulting coverlay covers the bulk of the traces on the flexible circuit substrate and only pad areas where interconnect is desired are exposed. The flexible circuit is then embossed to cause the contact pads to extend out of the plane of the flexible circuit substrate. This extension may or may not cause the contact pads to extend beyond the coverlay.

In a second approach, the flexible circuit substrate does not use a coverlay. All traces and the pads on the flexible circuit substrate remain exposed. In this approach, only those portions for which connection is desired are embossed, and only those embossed portions form electrical connection.

In either approach, the flexible circuit substrate is placed embossed side down over the anisotropic conductive film such that the embossed pads are aligned with the individual transducer elements. Suitable pressure and temperature are then applied. The regions of the anisotropic conductive film that are in contact with the embossed pads experience localized flow, resulting in the conductive particles within the anisotropic conductive film to come into contact with each other, as well as the transducer element and the embossed pad. This chain of conductive particles creates an electrical interconnect between the transducer element and the flex pad. The adhesive portion of the film also creates a permanent mechanical bond at this point. This process will result in the electrical interconnection to be formed, whether the flexible circuit has the coverlay or not.

Figure 6:
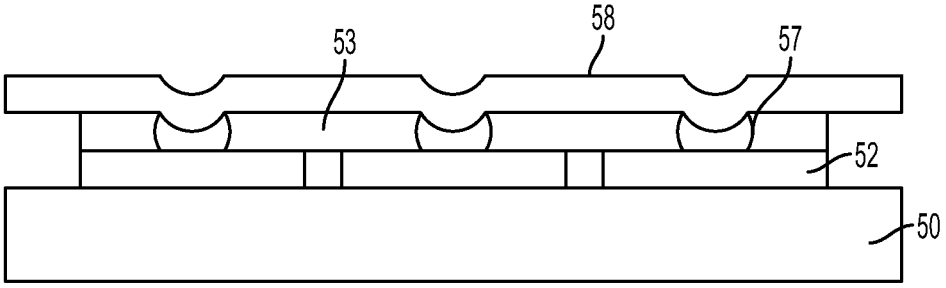
FIG. 6 shows an embodiment of an interconnect using anisotropic conductive film.

FIG. 6 shows an example of this type of an interconnect. The jet stack 50 has arranged upon it the array of transducers such as 52. The anisotropic conductive film 53 is arranged to cover the entire transducer array. Upon application of temperature and pressure, the resulting localized flow in the anisotropic conductive film causes regions 57 to form an electrical connection between the embossed portions of the flexible circuit array 58 and the transducer.

Figure 7:
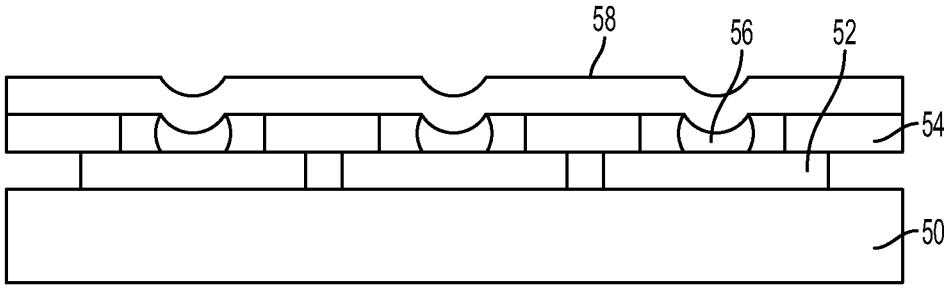
FIG. 7 shows an embodiment of an interconnect using a standoff layer and conductive adhesive.

The application of the embossed flexible circuit does not require the use of anisotropic conductive film. One can use more traditional means of forming the interconnect. FIG. 7 shows an embodiment of a portion of a print head having an embossed flexible circuit substrate with a standoff layer. The jet stack 50 has arranged on it an array of transducers, such that each transducer 52 in the array corresponds to a jet in the nozzle plate in the jet stack. The flexible circuit substrate 58 has embossed portions that extend out of the plane of the flexible circuit substrate at the contact pads.

A standoff layer 54 resides on the transducer layer such that openings in the standoff layer align with the transducers. A conductive adhesive 56 resides in the openings, having been deposited into the openings such as by stenciling or other patterning. The conductive adhesive forms the electrical interconnect between the embossed portions of the flexible circuit substrate and the transducer. In one embodiment, the conductive adhesive is dispensed into the openings and then the flexible circuit substrate can be aligned such that the embossed portions of the flexible circuit substrate extend into the openings.

Figure 8:
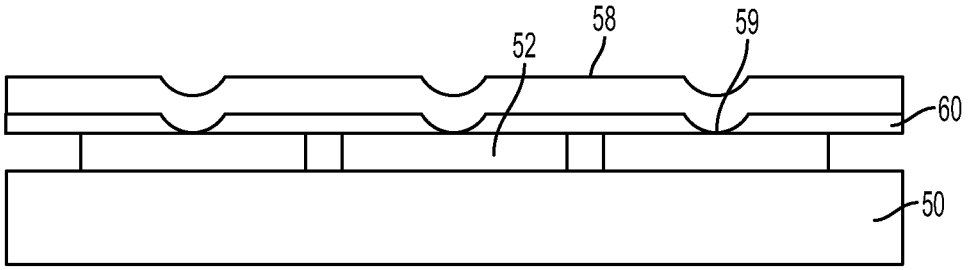
FIG. 8 shows an embodiment of an interconnect using a nonconductive adhesive.

In another embodiment, a nonconductive adhesive can reside between the embossed flexible circuit substrate and the transducer array. Enough pressure is applied to the flexible circuit array such that the embossed portions push through the nonconductive adhesive and make contact with the transducer directly. When the adhesive cures, it holds the contact regions in place. FIG. 8 shows an embodiment of this approach.

In the embodiment of FIG. 8, the jet stack has first arranged on it the array of electrical transducers such as 52. A layer of nonconductive adhesive 60 then resides on the array of transducers. The flexible circuit substrate 58 and its embossed portions then press down on the nonconductive adhesive until the embossed portions penetrate the nonconductive adhesive and make contact with the transducers as shown at 59.

Other variations and modifications exist. The arrays of transducers, jets and dimples may consist of one-dimensional or two-dimensional arrays. The size, shape, and height of dimples may vary by the embossing processes as desired by the particular application, jet density and jet count. The manner and composition of the conductive adhesive, the nonconductive adhesive, the coverlay and the standoff layers may change as needed by a particular application or mix of materials and their compatibilities.

In this manner, the embodiments disclose a robust interconnect architecture that has flexible manufacturing processes and structures. These interconnect embodiments provide this robustness even in view of increased jet density and higher jet counts.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A method of manufacturing a print head, comprising:

forming a jet stack having an array of jets;

arranging an array of transducers directly on the jet stack such that each transducer in the array of transducers connects to one of each jet in the array of jets;

after the arranging the array of transducers on the jet stack, embossing a flexible circuit substrate having contact pads on a surface of the flexible circuit using at least one of an arrayed die or an arrayed punch, such that the contact pads extend out of a plane of the flexible circuit substrate; and arranging the flexible circuit substrate such that the contact pads electrically connect to at least some of the transducers in the array of transducers, to form the print head.

2. The method of claim 1, wherein embossing the flexible circuit substrate comprises:

placing the flexible circuit substrate on a compliant pad in a press;

arranging the arrayed punch over the flexible circuit substrate such that individual ones of punches in the arrayed punch are aligned with the contact pads on the flexible circuit substrate; and pressing the arrayed punch onto the flexible circuit substrate until the contact pads permanently deform out of the plane of the flexible circuit substrate in a direction of the compliant pad.

3. The method of claim 1, wherein embossing the flexible circuit substrate comprises:

placing the flexible circuit substrate in a press, the press having the arrayed die and the flexible circuit substrate is arranged over the arrayed die such that holes in the arrayed die correspond to the contact pads on the flexible circuit substrate;

covering the flexible circuit with a compliant pad; and pressing the flexible circuit into the arrayed die until the contact pads permanently deform out of the plane of the flexible circuit in a direction of the holes in the arrayed die.

4. The method of claim 1, wherein embossing the flexible circuit substrate comprises:

placing the flexible circuit substrate in a press, the press having the arrayed die and the flexible circuit substrate is arranged over the arrayed die such that holes in the arrayed die correspond to the contact pads on the flexible circuit substrate;

arranging an arrayed punch over the flexible circuit substrate such that individual ones of punches in the arrayed punch are aligned with the contact pads on the flexible circuit substrate;

placing a compliant pad between the arrayed punch and a top portion of the press; and pressing the flexible circuit with the arrayed punch until the contact pads on the flexible circuit permanently deform out of the plane of the flexible circuit in the direction of the holes in the arrayed die.

5. The method of claim 1, wherein arranging the flexible circuit substrate comprises:

applying an anisotropic conductive film to the array of transducers;

arranging the flexible circuit substrate onto the anisotropic conductive film such that an array of conductive pads overlies the array of transducers; and applying temperature and pressure to the flexible circuit substrate and the anisotropic conductive film until localized flow occurs in regions of the anisotropic conductive film around the contact pads such that an electrical connection is made between the array of transducers and the array of contact pads through the regions.

6. The method of claim 5, wherein applying temperature and pressure also causes the anisotropic conductive film to create a mechanical between the flexible circuit substrate and the array of transducers.

7. The method of claim 1, further comprising forming a coverlay on the flexible circuit substrate such that only selected regions on the flexible circuit substrate are exposed before arranging the flexible circuit substrate.

8. The method of claim 7, wherein forming a coverlay comprises patterning the coverlay prior to applying a mask to the flexible circuit substrate.

9. The method of claim 7, wherein forming a coverlay comprises applying a coverlay layer to the flexible circuit substrate and removing selected portions of the coverlay layer over each contact pad.

10. The method of claim 9, wherein removing selective portions of the coverlay layer comprises using one of photolithography or laser ablation to remove the selected portions.

11. The method of claim 1, wherein arranging the flexible circuit substrate comprises:

applying a standoff layer to the array of transducers, the standoff layer having openings corresponding to at least a portion of the array of transducers;

dispensing a conductive adhesive into the openings; and arranging the flexible circuit substrate on the standoff layer such that the contact pads extend into the openings and make an electrical connection with the array of transducers through the conductive adhesive.

12. The method of claim 1, wherein arranging the flexible circuit substrate comprises:

applying a nonconductive adhesive to the array of transducers;

arranging the flexible circuit substrate on the nonconductive adhesive layer so that contact pads align with the array of transducers; and pressing the flexible circuit substrate against the nonconductive adhesive layer such that the contact pads penetrate the nonconductive adhesive layer and make connection with the transducer.

13. The method of claim 12, further comprising forming a mechanical bond between the array of transducers and the contact pads with the nonconductive adhesive.

* * * * *